US007669266B2

(12) United States Patent
Palmer et al.

(10) Patent No.: US 7,669,266 B2
(45) Date of Patent: Mar. 2, 2010

(54) NO SHIFT CHAMBERED BODY PILLOW

(75) Inventors: Brandon Palmer, Chicago, IL (US); Robert J. Hickman, Wilmette, IL (US)

(73) Assignee: United Feather & Down, Inc., Des Plaines, IL (US)

( * ) Notice: Subject to any disclaimer, the term of this patent is extended or adjusted under 35 U.S.C. 154(b) by 0 days.

(21) Appl. No.: 12/112,426

(22) Filed: Apr. 30, 2008

(65) Prior Publication Data

US 2009/0025147 A1 Jan. 29, 2009

Related U.S. Application Data

(60) Provisional application No. 60/914,827, filed on Apr. 30, 2007.

(51) Int. Cl.
*A47G 9/00* (2006.01)

(52) U.S. Cl. ..... 5/645; 5/636

(58) Field of Classification Search ..... 5/636, 5/644, 640, 638, 911, 655.4, 702, 711, 655, 5/645

See application file for complete search history.

(56) References Cited

U.S. PATENT DOCUMENTS 1,212,515 A * 1/1917 Leavitt ..... 5/636
1,746,709 A * 2/1930 Marshall ..... 441/129
2,589,303 A * 3/1952 Sourbeck ..... 5/645
3,411,164 A * 11/1968 Sumergrade ..... 5/644
4,754,510 A 7/1988 King
5,038,432 A * 8/1991 Robillard et al. ..... 5/645
5,237,714 A * 8/1993 Baron ..... 5/636
5,584,086 A * 12/1996 VanWinkle et al. ..... 5/644
5,797,153 A 8/1998 Amioka
6,161,239 A * 12/2000 Grazel ..... 5/655
6,751,817 B1 6/2004 Leach
7,074,242 B2 7/2006 Palmer et al.

* cited by examiner

*Primary Examiner*—Alexander Grosz
(74) *Attorney, Agent, or Firm*—Mark Montague; Cowan, Liebowitz & Latman, P.C.

(57) ABSTRACT

A body pillow includes an outer enclosure, first, second and third chambers disposed within the outer enclosure, the first and second chambers disposed adjacent to one another, and the second and third chambers disposed adjacent to one another, each of the first, second and third chambers adapted to be filled by respective filling material, a first baffle disposed between the first and second chambers, and a second baffle disposed between the second and third chambers, the first and second baffles adapted to prevent filling material within each of the first, second and third chambers from shifting to an adjacent one of the chambers. Beneficially, among other benefits, the body pillow's baffles prevent filling material disposed within each of the chambers from shifting to adjacent chambers, both during normal use of the body pillow and during washing.

9 Claims, 2 Drawing Sheets

NO SHIFT CHAMBERED BODY PILLOW

REFERENCE TO RELATED APPLICATION

This application claims priority to U.S. Provisional Patent Application No. 60/914,827, filed Apr. 30, 2007, the disclosure of which is incorporated herein by reference.

FIELD OF THE INVENTION

The present invention relates to a body pillow. More particularly, the present invention relates to a body pillow including multiple internal chambers that provide certain advantageous features as described below.

DESCRIPTION OF THE RELATED ART

There are many types of pillows. There are pillows for infants, for children and for adults. There are standard pillows that support the head, usually used while sleeping in a bed. There are pillows that support the body, such as those used on a sofa or chair. There also are throw pillows. The so-called body pillow generally is sufficiently long to support the user's arms, body and legs while laying down. Body pillows with different shapes have been proposed, including an orthopedic body pillow as disclosed in U.S. Pat. No. 5,797,153, a contoured body pillow as disclosed in U.S. Pat. No. 6,751,817, a bow shaped body pillow as disclosed in U.S. Pat. No. 4,754,510, among others. For purposes of construction, components, filling materials, and other features of known pillows, the disclosures of U.S. Pat. Nos. 5,797,153; 6,751,817 and 4,754,510 are incorporated herein by reference.

While pillows of various shapes and styles are currently available and/or previously proposed, there still remain certain novel body pillow shapes and designs and, moreover, internal constructions of such novel pillows.

SUMMARY OF THE INVENTION

In accordance with the present invention, a body pillow (or, hereinafter, a "pillow") comprises a plurality of internal chambers, each of the chambers having respective filling material therein, and a baffle disposed between adjacent ones of the chambers and adapted to prevent filling material within one of the chambers from moving to an adjacent chamber.

As an aspect of the invention, each of the chambers includes a respective chamber access opening adapted to be selectively opened and closed, the respective chamber being accessible to enable filling material to be inserted into or removed from the respective chamber when the respective chamber access opening is opened, and the respective chamber not being accessible when the respective chamber access opening is closed.

As another aspect of the invention, each of the chambers of the pillow has the same dimensions.

As a further aspect of the invention, the pillow has an outer enclosure in which the plurality of internal chambers are disposed, the outer enclosure having an external appearance of a single pillow and concealing the existence of the plurality of internal chambers disposed within the outer enclosure of the pillow.

As an additional aspect of the invention, in another variation, the pillow has an outer enclosure in which the plurality of internal chambers are disposed, the outer enclosure having an external appearance revealing the existence of the plurality of internal chambers disposed within the outer enclosure of the pillow.

As yet another aspect of the invention, the filling material within a first of the chambers is of a type different from the filling material within a second of the chambers.

In accordance with the present invention, a pillow comprises an outer enclosure; first, second and third chambers disposed within the outer enclosure, the first and second chambers disposed adjacent to one another, and the second and third chambers disposed adjacent to one another, each of the first, second and third chambers adapted to be filled by respective filling material; a first baffle disposed between the first and second chambers and a second baffle disposed between the second and third chambers, the first and second baffles adapted to prevent filling material within each of the first, second and third chambers from shifting to an adjacent one of the chambers.

As an aspect of the invention, each of the first, second and third chambers includes a respective chamber access opening adapted to be selectively opened and closed, each of the respective one of the chambers being accessible to enable filling material to be inserted into or removed from the respective chamber when the respective chamber access opening is opened, and the respective chamber not being accessible when the respective chamber access opening is closed.

As another aspect of the invention, the first, second and third chambers have the same dimensions.

As a further aspect of the invention, the first and third chambers have the same first length, and the second chamber has a length substantially longer than the first length.

As an additional aspect of the invention, the outer enclosure has an external appearance of a single pillow and concealing the existence of the first, second and third chambers disposed within the outer enclosure of the pillow.

As yet another aspect of the invention, as another variation, the outer enclosure has an external appearance revealing the existence of the first, second and third chambers disposed within the outer enclosure of the pillow.

As yet a further aspect of the invention, filling material within a first of the chambers is of a type different from filling material within a second of the chambers.

As yet an additional aspect of the invention, the first, second and third chambers are disposed along a single axis extending along a length of the outer enclosure of the pillow.

Various other features, objects and advantages of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

Figure 1:
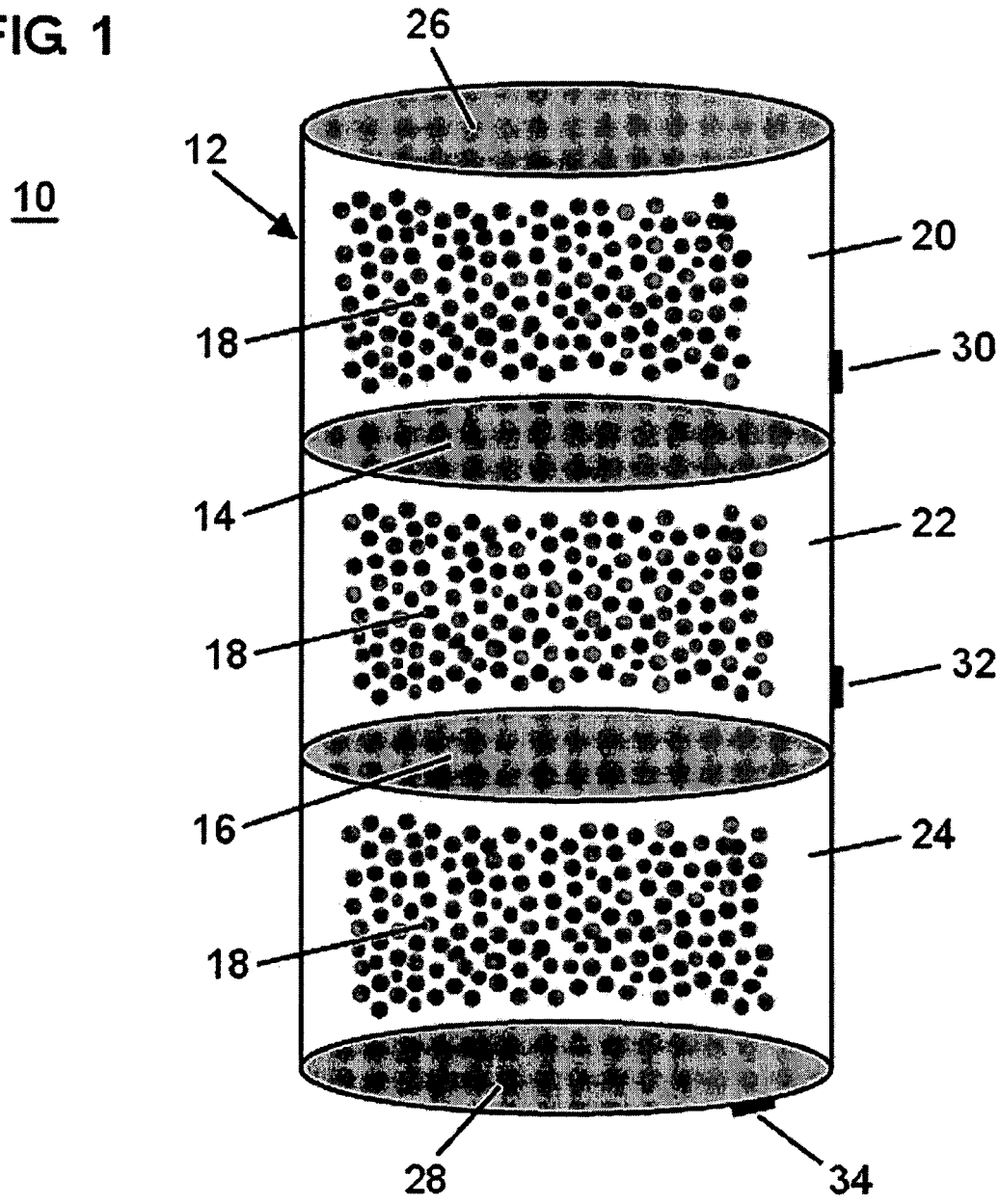
FIG. 1 is a schematic illustration of the body pillow in accordance with the present invention.

The body pillow of the present invention is comprised of three separate chambers, each with filling material therein. Referring now to the drawings, and particularly to FIG. 1 thereof, body pillow 10 of the present invention includes a housing 12 that is comprised of three separate chambers 20, 22 and 24. The chambers are internally separated from one another by two baffles 14 and 16. In particular, the first baffle 14 separates first chamber 20 from second chamber 22, and the second baffle 16 separates second chamber 22 from third chamber 24. Body pillow 10 also includes ends 26 and 28, as shown.

Each of the three chambers 20, 22 and 24 is filled with suitable filling material 18. Filling material 18 may be cotton, polyester, feathers, down, a combination of feathers and down, or other known filling material. Filling material 18 may also be the filling material described in U.S. Pat. No. 7,074,242, generally referred to as Lyocell Down. U.S. Pat. No. 7,074,242 is owned by the assignee of the present invention and is incorporated herein by reference. Each of the chambers may be filled with the same filling material to provide the same, or nearly the same, firmness levels as well as other characteristics (e.g., amount of "memory"). The chambers also may have different densities of the same filling material to provide chambers with different characteristics, such as firmness levels and/or thicknesses. Alternatively, the chambers may be filled with different filling materials. For example, each of the three chambers may be filled with different filling materials thus provide pillow segments with different characteristics. As another example, chambers 20 and 24 are filled with the same filling material, and middle chamber 22 is filled with a different filling material thus providing a pillow mid-section that has one or more different characteristics than the outer ends of the pillow.

Each chamber 20, 22 and 24 preferably is filled with filling material 18 via a respective chamber access opening 30, 32 and 34. Each opening preferably includes a suitable mechanism for preventing filling material 18 from leaving the respective chamber, such as by use of a zipper connection, a Velcro connection or other known, appropriate device. The size and location of each opening 30, 32 and 34 may differ from that shown in the figures.

Body pillow 10 of the present invention may be manufactured from any suitable material, such as cotton, although other materials may be utilized. Body pillow 10 may have the dimensions of, for example, 60 inches by 20 inches by 6 inches, thus providing an oval cross-section. The body pillow of the present invention may have different dimensions and/or shape, including a round cross-section. Preferably, although not necessarily, chambers 20, 22 and 24 have the same dimensions (e.g., 20 inches by 20 inches by 6 inches) and generally the same shape. In a variation, the chambers have different dimensions and/or shapes. As an example, chamber 22 (i.e., the central chamber) has a length substantially longer than the two outer chambers 20 and 24.

In accordance with the present invention, baffles 14 and 16 of body pillow 10 prevent filling material 18 within each of the chambers from shifting to the other chambers. Thus, normal use of the body pillow of the present does not cause filling material to shift. The construction of the body pillow of the present invention as described herein also prevents shifting of filling material during washing, including washing of the body pillow in residential or commercial washing machines. The construction of the body pillow of the present invention further advantageously provides for a product with a consistent density along its top, middle and bottom sections. Still further, the multi-compartment/multi-baffle construction of the body pillow of the present invention provides for better washability, due to the lack of shifting of filling material between the body pillow's sections.

Figure 2:
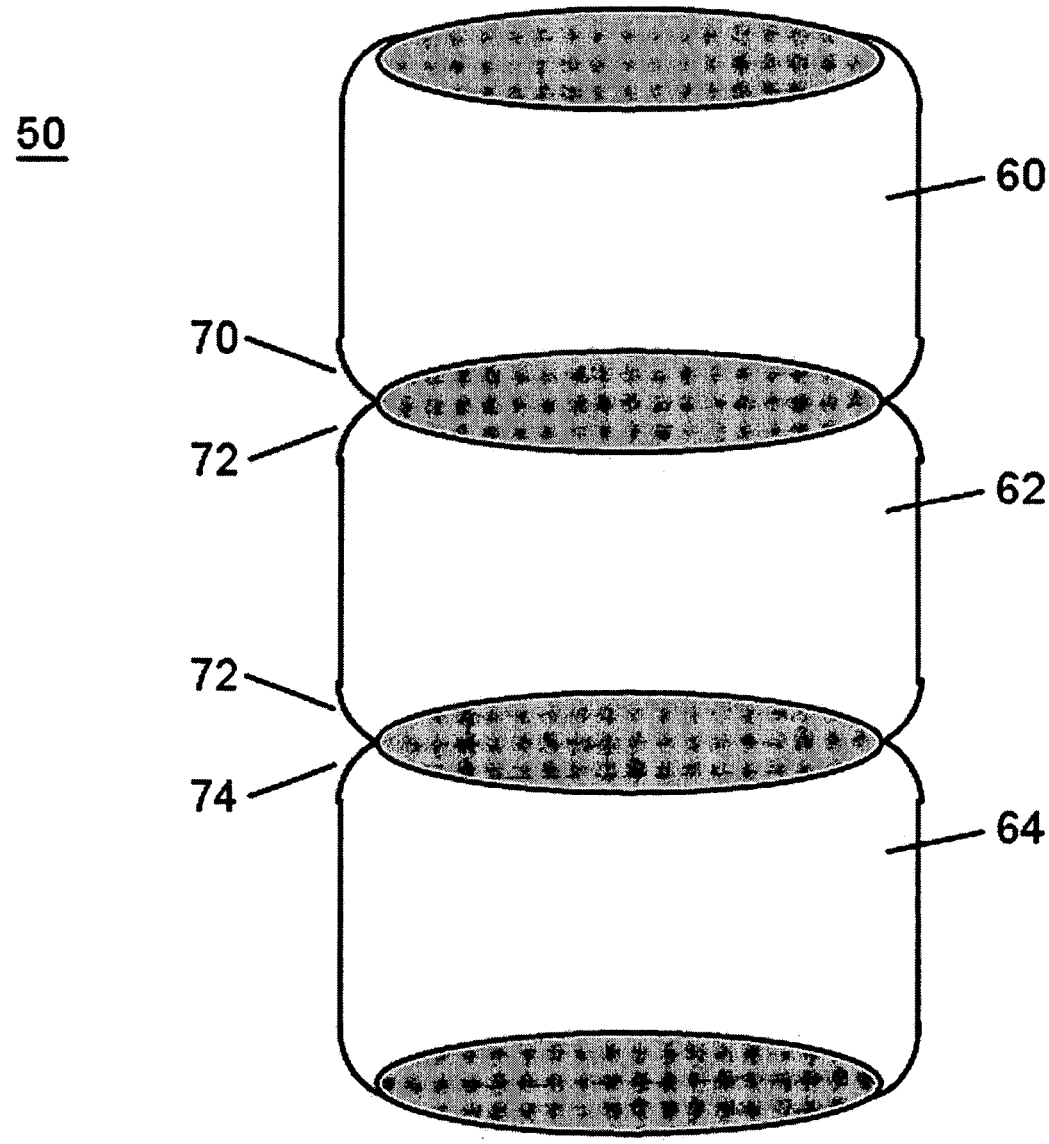
FIG. 2 is a schematic illustration of a body pillow in accordance with another embodiment of the present invention.

Body pillow 10 of the present invention and as shown in FIG. 1 includes multiple, internal compartments, while providing an exterior appearance of a single pillow. However, the present invention includes body pillows that have an external appearance that visibly show each of the multiple compartments. In particular, FIG. 2 of the drawings is a schematic diagram of body pillow 50 in accordance with another embodiment of the present invention. As shown in FIG. 2, each of the three chambers 60, 62 and 64 has a shape in which the respective inner edges (e.g., 70, 72 and 74) curve inward, so that the multiple compartment construction is visible. As shown in the exemplary design presented in FIG. 2, body pillow 50 externally has the appearance of three relatively smaller, distinct pillows disposed in a side-by-side and contacting arrangement.

The construction of body pillow 50 has an exterior appearance of three pillows that are adjacent and in contact with one another. The first embodiment shown in FIG. 1 may also, in a variation thereof, have an exterior appearance of three distinct pillows disposed adjacent to and in contact with one another. In either case, the body pillow of the present invention may be used in the ordinary manner, that is, to support a person's arms, body and/or legs, and further may be placed (generally when not in use by a person) at the head of a bed (or other location and/or on another piece of furniture, e.g., a sofa). Thus, when not in use, various designs of the body pillow of the present invention operate as a functionally decorative element.

The present invention has been described above and shown in the drawings. The body pillow of the present invention may have different configurations. For example, the body pillow may have a different number of multiple compartments than that shown in the drawings (e.g., four compartments, five compartments, etc.). The body pillow may have various different shapes and/or sizes. For example, the body pillow may have a cross-section that is round, as already mentioned, or another different shaped cross-section. The body pillow may have different lengths, widths, depths, etc. Moreover, the present invention has been described with reference to drawings that show multiple compartments that are disposed along a single axis (i.e., a straight line) that extends along a length of the pillow. The present invention, however, is not limited to this construction and includes body pillows that include compartments that do not extend along a straight line. For example, the compartments may extended a long a curved line, so as to provide a sort-of curved body pillow with multiple compartments disposed within in. Hence, while the present invention has been described in the context of a number of embodiments and variations, it is to be understood that other expedients known to those skilled in the art may be employed without departing from the spirit of the invention.

What is claimed is:

1. A pillow, comprising:

a plurality of internal chambers, each of the chambers having respective substantially solid filling material therein;

a baffle disposed between adjacent ones of the chambers and adapted to prevent filling material within one of the chambers from moving to an adjacent chamber; and an outer enclosure in which the plurality of internal chambers are disposed, the outer enclosure over each of the internal chambers having edges approaching the baffle that curve inward along the entire periphery of the baffle to produce an external appearance of a plurality of pillows disposed in a side-by-side and contacting arrangement wherein each of the chambers includes a respective chamber access opening adapted to be selectively opened and closed, the respective chamber being accessible to enable a substantially solid filling material to be inserted into or removed from the respective chamber when the respective chamber access opening is opened, and the respective chamber not being accessible when the respective chamber access opening is closed.

2. The pillow of claim 1, wherein each of the chambers of the pillow has the same dimensions.

3. The pillow of claim 1, wherein the filling material within a first of the chambers is of a type different from the filling material within a second of the chambers.

4. A pillow, comprising:

an outer enclosure;

first, second and third chambers disposed within the outer enclosure, the first and second chambers disposed adjacent to one another, and the second and third chambers disposed adjacent to one another, each of the first, second and third chambers filled by substantially solid filling material;

a first baffle disposed between the first and second chambers and a second baffle disposed between the second and third chambers, the first and second baffles adapted to prevent filling material within each of the first, second and third chambers from shifting to an adjacent one of the chambers; and the outer enclosure over each of the chambers having edges approaching a respective one of the first and second baffles that curve inward along the entire periphery of the baffle to produce an external appearance of a plurality of pillows disposed in a side-by-side and contacting arrangement wherein each of the chambers includes a respective chamber access opening adapted to be selectively opened and closed, the respective chamber being accessible to enable a substantially solid filling material to be inserted into or removed from the respective chamber when the respective chamber access opening is opened, and the respective chamber not being accessible when the respective chamber access opening is closed.

5. The pillow of claim 4, wherein the first, second and third chambers has the same dimensions.

6. The pillow of claim 4, wherein the first and third chambers have the same first length, and the second chamber has a length substantially longer than the first length.

7. The pillow of claim 4, wherein filling material within a first of the chambers is of a type different from filling material within a second of the chambers.

8. The pillow of claim 4, wherein the first, second and third chambers are disposed along a single axis extending along a length of the outer enclosure of the pillow.

9. The pillow of claim 4, wherein each of the internal chambers has a round cross-section and the baffle has a round shape with a diameter smaller than a diameter of each of the internal chambers.

* * * * *